US005689272A

United States Patent [19]

Harrison et al.

[11] Patent Number: 5,689,272

[45] Date of Patent: Nov. 18, 1997

[54] METHOD AND SYSTEM FOR PRODUCING ANTENNA ELEMENT SIGNALS FOR VARYING AN ANTENNA ARRAY PATTERN

[75] Inventors: Robert Mark Harrison, Grapevine; Mark Van Horn, Arlington; Walter Joseph Rozanski, Jr., Hurst, all of Tex.

[73] Assignee: Motorola, Inc., Schaumburg, Ill.

[21] Appl. No.: 681,772

[22] Filed: Jul. 29, 1996

[51] Int. Cl.[6] ..... H01Q 3/22; H01Q 3/24; H01Q 3/26

[52] U.S. Cl. ..... 342/373; 342/372

[58] Field of Search ..... 342/373, 372, 342/81, 157

[56] References Cited

U.S. PATENT DOCUMENTS

| | | | |
|---|---|---|---|
| 5,115,248 | 5/1992 | Roederer | 342/373 |
| 5,548,295 | 8/1996 | Lo Forti et al. | 342/373 |
| 5,563,609 | 10/1996 | Wachs | 342/372 |

*Primary Examiner*—Theodore M. Blum
*Attorney, Agent, or Firm*—Bruce Terry

[57] ABSTRACT

In a method and system for producing a plurality of antenna element signals that produce a selected antenna array pattern, first (56) and second (58) input signals are coupled to first (82) and second (84) amplifiers, respectively. The amplitude of said first input signal is modified (68) according to a first factor to produce a first modified signal, and the amplitude of said second input signal is modified (66) according to a second factor to produce a second modified signal. The first input signal is combined (48) with the second modified signal to produce a first combined signal, and the second input signal is combined (50) with the first modified signal to produce a second combined signal. Thereafter, the first combined signal and the second combined signal are amplified using first (82) and second (84) amplifiers, respectively. Next, the amplified signals are transformed with a transform matrix (96) to produce the plurality of antenna element signals.

15 Claims, 3 Drawing Sheets

METHOD AND SYSTEM FOR PRODUCING ANTENNA ELEMENT SIGNALS FOR VARYING AN ANTENNA ARRAY PATTERN

FIELD OF THE INVENTION

The present invention is related in general to radio frequency transmitter systems, and more particularly to an improved method and system for producing a plurality of antenna element signals for producing a selected antenna array pattern.

BACKGROUND OF THE INVENTION

Antenna arrays may be constructed of a plurality of antenna elements that are precisely located relative to one another and precisely driven by a group of antenna element signals that have selected amplitude and phase relationships with one another. By varying the amplitude and phase relationship between antenna element signals in such a group of antenna element signals, the radiation pattern of the antenna array may be selected.

In radio communication systems, it is often desirable to selectively steer a beam radiated from an antenna array. Furthermore, the power transmitted in such a beam should be concentrated in a well defined main lobe of an antenna pattern, and power in sidelobes of the antenna pattern should be kept as low as possible. If sidelobes are not maintained below a selected threshold, such sidelobes may become the source of interference in adjacent radio frequency coverage areas.

FIG. 1 illustrates a typical antenna array pattern that may be used in a cellular communications system. The vertical axis of the graph in FIG. 1 represents the magnitude response, in dB, and the horizontal axis represents a direction, in degrees, away from a central axis of the antenna array. Most of the power radiated by the antenna array associated with FIG. 1 is concentrated in main lobe 20, which is centered along a central axis at zero degrees. Sidelobes 22 off to the side of the central axis represent that much less power is transmitted in directions other than the direction of main lobe 20. Ideally, to provide radio frequency signal isolation from adjacent communications system coverage areas, sidelobes 22 are nonexistent, or at least kept to a very low power level. Depending upon the application, cellular systems designers may attempt to keep sidelobes 22 20 dB or more below the magnitude of main lobe 20. Thus, FIG. 1 shows that radiated power may be concentrated along an axis or a ray that departs the antenna array in a particular direction relative to a central axis. The intensity of radiated energy in off-axis rays is significantly lower.

Without moving the antenna array, the radiation pattern of the antenna array may be modified so that main lobe 20 extends from the antenna array at an angle other than zero degrees from the central axis. This is illustrated by the chart of the antenna pattern in FIG. 2. In FIG. 2, main lobe 20 leaves the antenna array at approximately a 67° angle. This change in the antenna pattern may be referred to a steering the beam of the antenna array. Such beam steering is accomplished by varying the phase, and sometimes the amplitude relationship, between signals that drive the antenna elements in the array.

One way of reducing side lobe magnitude in an antenna array pattern is to non-uniformly illuminate elements of the antenna array. In order to produce non-uniform antenna element signals, some of the antenna element signals may be attenuated. If sidelobes that are 20 dB or lower are desired, the attenuation of signals that drive some elements is about 3 dB. If the antennas in the array are driven with high power signals, a 3 dB power attenuation in some of the element signals can be very expensive, not only because power is converted to heat, but because high power amplifiers are expensive to design and manufacture.

In other methods of beam steering, all antenna inputs are scaled or modified by complex factors or weights that are selected for the desired beam pattern. Each of these scaled antenna inputs are summed, amplified, and sent to the antenna elements. In this method, each antenna element signal includes complex components of every other input signal. Modifying every input signal with a complex gain for every antenna element in the array may require a large number of complicated circuits.

Therefore, a need exists for an improved method and system for producing a plurality of antenna element signals for producing selected antenna array patterns, wherein power transmitted in sidelobes of such antenna patterns is minimized, power loss due to signal attenuation is minimized, and circuit complexity is minimized.

BRIEF DESCRIPTION OF THE DRAWINGS

The novel features believed characteristic of the invention are set forth in the appended claims. The invention itself, however, as well as a preferred mode of use, further objects, and advantages thereof, will best be understood by reference to the following detailed description of an illustrative embodiment when read in conjunction with the accompanying drawings, wherein:

DETAILED DESCRIPTION OF THE INVENTION

Figure 1:
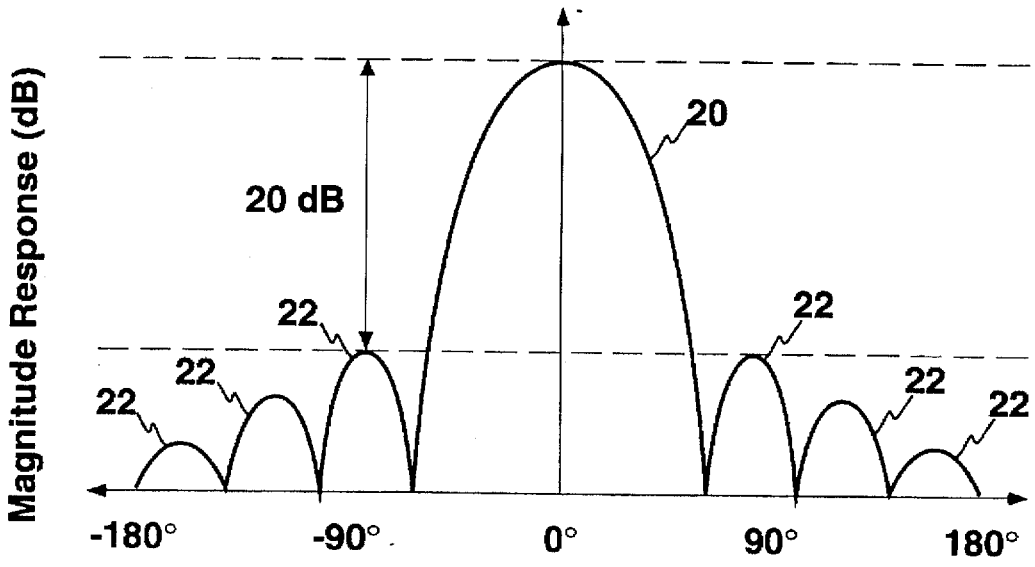
FIG. 1 depicts an antenna array pattern having a main lobe extending from a central axis.
Figure 2:
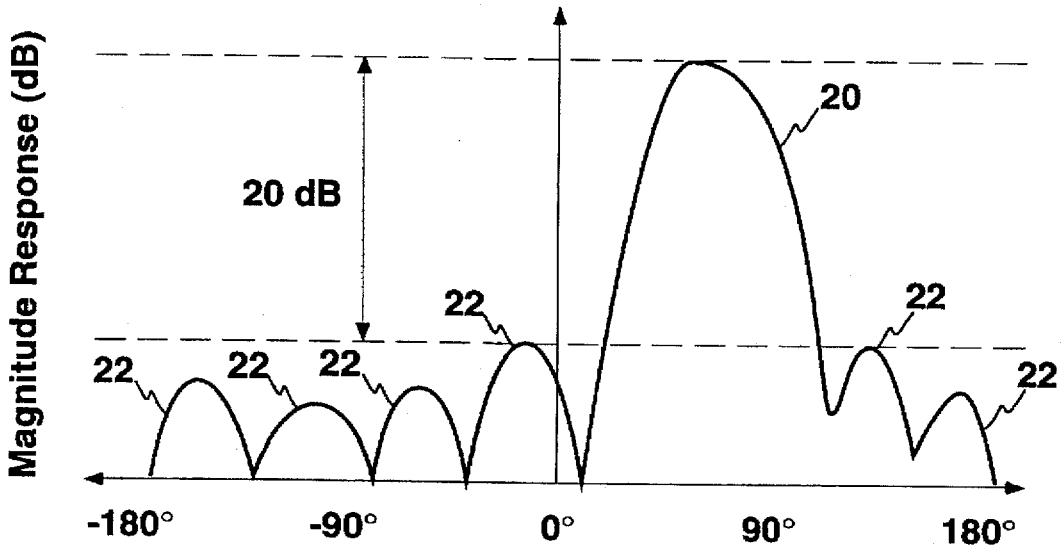
FIG. 2 depicts an antenna array pattern having a main lobe that has been steered approximately 67° away from the central axis.
Figure 3:
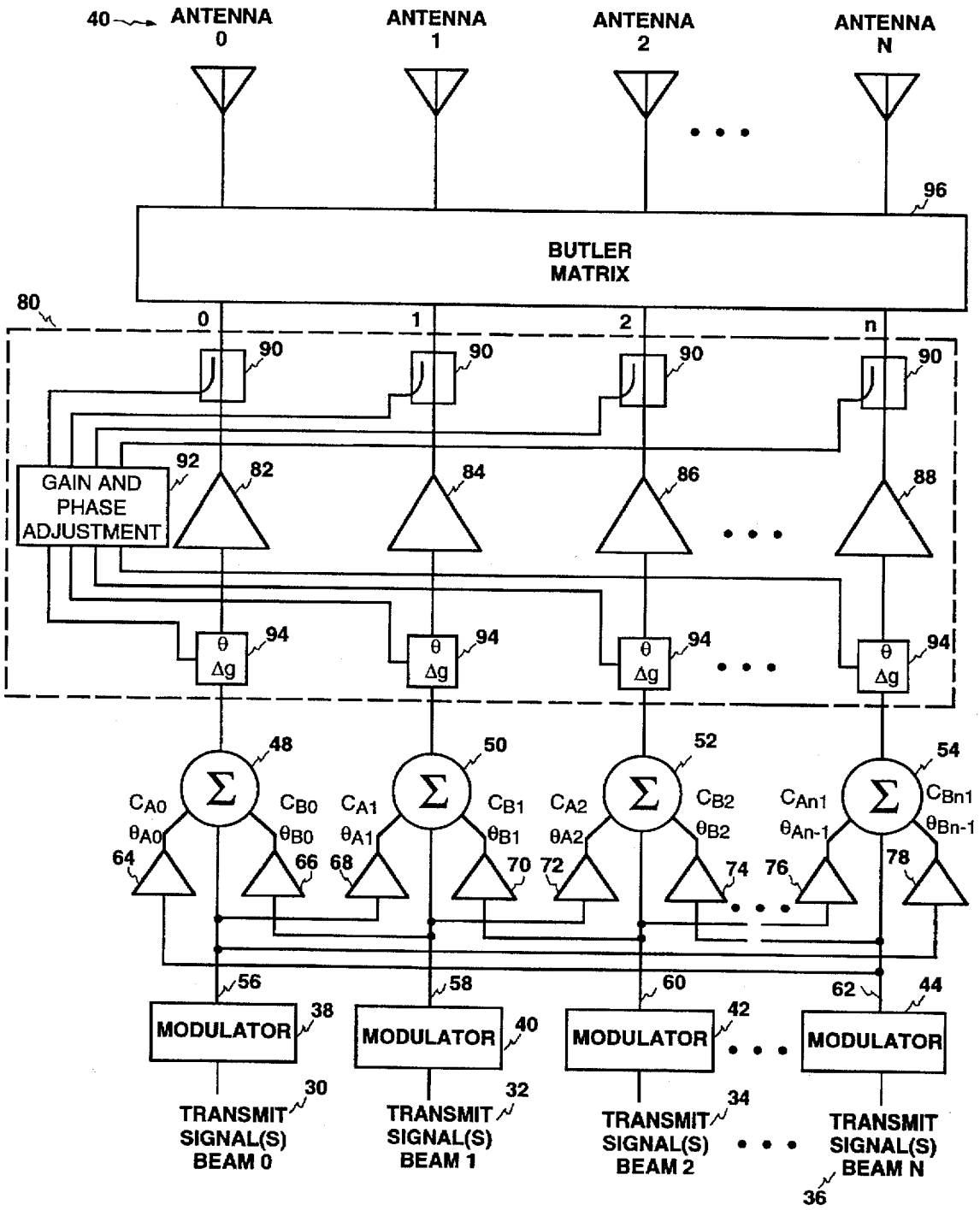
FIG. 3 illustrates a system for producing a plurality of antenna element signals for producing a selected antenna array pattern in accordance with the method and system of the present invention.

With reference now to the figures, and in particular with reference to FIG. 3, there is depicted a block diagram of a system for producing a plurality of antenna element signals for producing a selected antenna array pattern in accordance with the method and system of the present invention.

As illustrated, a plurality of transmit signals 30–36 are coupled to modulators 38–44. Each transmit signal 30–36 will be transmitted from antenna array 40, which comprises antennas 0–N, in a different direction from a central axis of the antenna array. Thus, if a designer wishes to have a transmitted signal leave the antenna array with a majority of the power transmitted at an angle of say 45° from the central axis of the array, the designer inputs that transmit signal into a selected one of the modulators 38–44. If signal transmission at another angle from the central axis of the antenna array is desired, another modulator 38–44 is selected for that transmit signal. In this manner, a designer may transmit a selected transmit signal in a selected direction from the central axis of the antenna array without moving the antenna array. This beam steering capability is useful in spatial division multiple access communications systems, and other systems that use cell sectorization.

Outputs 56–62 of modulators 38–44 are coupled, respectively, to combiners 48–54. These combiners 48–54 are used to combine, or sum two or more signals to produce a combined signal at the output of the combiner. Combiners 48–54 may be implemented with either digital or analog circuits, depending upon the form of transmit signals 30–36 and the other signals input into combiners 48–54.

In the present invention, the outputs of modulators 38–44 may be considered input signals 56–62 for the system for producing the plurality of antenna element signals. Thus, input signals 56–62 are not only coupled to combiners 48–54, each input signal 56–62 is also coupled to one or more signal gain modifiers 64–78. Such signal gain modifiers 64–78 are used to vary the amplitude of input signals 56–62 and, in some instances, the phase of input signals 56–62. For example, signal gain modifier 64 modifies the amplitude of input signal 56 according to a first factor $C_{AO}$, and may vary the phase of input signal 56 according to a factor $\theta_{AO}$. Together, amplitude factor $C_{AO}$ and phase factor $\theta_{AO}$ form what may be referred to as a complex factor that describes how signal gain modifier 64 modifies both the gain and the phase of input signal 56. As shown in FIG. 3, signal gain modifiers 64–78 may have factors that are independent of one another. For example, a gain factor of signal gain modifier 64 is represented as $C_{AO}$, while the gain factor in signal gain modifier 66 is represented as $C_{BO}$.

The purpose of signal gain modifiers 64–78 is to provide a prefiltering function as part of the process for producing a plurality of antenna element signals to produce a desired antenna array radiation pattern. This prefiltering function is discussed in greater detail below. Note that this filtering function may be done with either digital or analog circuitry, but will preferably be done with the same type of circuitry as combiners 48–54.

If the bandwidth of modulated input signals 56–62 exceeds a selected bandwidth, the gain and phase adjustments made by signal gain modifiers 64–78 may be a function of frequency. If the gain and phase adjustments are a function of frequency, signal gain modifiers 64–78 may be implemented with digital or analog adaptive filters.

Combined signals at the outputs of combiners 48–54 are coupled to an amplifier array 80. Amplifier array 80 may include amplifiers 82–88 for amplifying radio frequency signals. Amplifiers 82–88 are preferably implemented with linear power amplifiers, such as the linear power amplifier sold under model number "PHM1990-15" by M/A-COM of Lowel, Mass.

Gain and phase correction circuits may also be part of amplifier array 80. The purpose of such gain and phase correction circuits is to reduce or eliminate gain and phase errors introduced by amplifiers 82–88 or other sources of error, such as differences in transmission path length between various input-to-output paths in amplifier array 80.

As shown in FIG. 3, gain and phase correction circuits may be implemented with amplitude and phase sensors 90 coupled to the outputs of amplifiers 82–88, gain and phase error measurement circuit 92, and gain and phase correction circuits 94 located in the signal path between each combiner 48–54 and amplifier 82–88. Amplitude and phase sensors 90 may be implemented with a coupler that receives a small amount of signal from the outputs of amplifiers 82–88. An example of such a coupler is the directional coupler sold under model number "4242-30" by Narda-Loral Microwave in Hauppauge, N.Y.

Gain and phase error measurement circuit 92 receives signals from amplitude and phase sensors 90 and uses such signals to produce control signals for gain and phase correction circuits 94. Gain and phase error measurement circuit 92 may be implemented with techniques similar to those used in carrier cancellation algorithms for feedforward power amplifiers. For example, the gain and phase of one beam path may be tuned relative to its adjacent beam paths, or relative to a beam path selected to serve as a reference beam path. The goal of gain and phase error measurement circuit 92 is to produce control signals that will eliminate any gain or phase changes in outputs of amplifiers 82–88 relative to one another.

Gain and phase correction circuits 94 are used to change the gain and phase of signals before they enter amplifiers 82–88 according to control signals generated by gain and phase error measurement circuit 92. Such gain and phase correction circuits 94 may be implemented with custom circuits or the complex vector attenuator sold under the part number "1098" by AT&T. If the modulated signals exceed a selected bandwidth, the gain and phase may be frequency dependent.

After amplification, the amplified signals produced by amplifier array 80 are coupled to inputs of transform matrix 96. Transform matrix 96 may be implemented with an n by n Butler matrix, or similar transform matrix characterized by circular convolution in the frequency domain being equal to multiplication in the time domain. The number of inputs and outputs is typically selected to match the number of antenna elements 40.

Because a Butler matrix may be constructed of ideally lossless passive components, little power is lost in the Butler matrix. This is an advantage because power losses in the high power signal path subsequent to amplifier array 80 are costly, wasting power that could otherwise be transmitted. In a system limited by range, directing this power to the antenna array can be critical to system operation.

Because a Butler matrix distributes power at one of n inputs evenly over n outputs, an antenna array illuminated by Butler matrix outputs produced by discrete amplified beam signals at the Butler matrix input produces directed beams having sidelobes only 13 dB below the magnitude of the main lobe. If sidelobes more than 13 dB below the main lobe are required, the antenna array must be illuminated with signals having different amounts of power.

In the prior art, high-power antenna element signals directed to selected antenna elements were attenuated, in some instances as much as 3 dB, when sidelobes 20 dB below the main lobe are desired. Consider, for example, a 7 element uniform linear array illuminated by a Tschebycheff signal weighting, the power in the antenna element signals will have the following relationships: [0.507, 0.682, 0.912, 1.0, 0.912, 0.682, 0.507]. The ratio of the power lost in a Tschebycheff illumination compared to a uniform illumination is 2.3 dB, which means for equivalent power output in the two systems, the power amplifiers in the Tschebycheff system must compensate for a factor of 1.7, or a 41% loss in power. For sidelobes at 30 dB down, an antenna array driven with prior art methods can experience a 3.2 dB loss in power.

In the present invention, transform matrix 96 is essentially a discrete Fourier transformer (DFT). The inputs to the transform matrix, which correspond to each beam, may be considered spatial frequencies, while the outputs for each antenna element may be considered spatial time samples. In the present invention, transform matrix 96 performs a discrete Fourier transform of the inputs. That is, the phase shifting and summing in the transform matrix can be expressed as a DFT. Thus, the inputs to the matrix are analogous to time samples, while the outputs are analogous to frequency. (This leads to the term "spatial frequency" to refer direction of propagation, and the term "spatial filtering" to beamforming.)

The equivalence of the transform matrix to a DFT can be exploited to compute the weights for the beamforming method and system of the present invention. First note that circular convolution in the frequency domain is multiplication in the time domain. That is, $$DFT\{w*x\}=DFT\{w\}\cdot DFT\{x\}$$

where "*" represents circular convolution and "·" represents element-wise multiplication.

Now the weighted output of transform matrix 96 can be expressed as:

$$w\cdot DFT\{x\}$$

where w is a vector containing the illumination amplitude of each antenna element, and x is the vector of inputs to the transform matrix. Applying the identity above, the following equation is obtained:

$$DFT\{W\}\cdot DFT\{x\}=DFT\{W*x\},$$

where W is the inverse DFT of w. This means that the array illumination may be tapered by circularly convolving, or prefiltering, the inputs to the transform matrix.

Typical illumination functions have sparse frequency domain representations. Therefore, a prefilter may be implemented with a only a few significant combining weights, or "taps," making prefilter implementation relatively straightforward.

For example, consider a 20 dB Tschebycheff weighting for a 7 element antenna array, the input signal modifications to produce the taps are as follows: [(1+j0), (−0.159+j0.077), (−0.000+j0.000), (0.001−j0.003), (0.001+j0.003), (−0.000−j0.000), and (−0.159−j0.077)]. Note that only the first two and the last taps have significant values. Furthermore, replacing the taps by their absolute value times the sign of the real part does not significantly increase the energy in the sidelobes. Thus, the three required taps would be: [1, −0.177, 0, 0, 0, 0, −0.177].

Calculations indicate that antenna patterns for beams steered 35° using the full set of 7 complex weights have sidelobes that are only 2 dB lower than sidelobes in patterns generated by the truncated set of 3 real weights. A significant advantage of the present invention is that a simple 3-tap prefilter, such as the prefilter consisting of signal gain modifiers 64–78 shown in FIG. 3, may be used to produce patterns having sidelobe levels that are down 20–30 dB from the main lobe. In the prior art, a 7-tap complex prefilter is required to obtain slightly better results.

Beam patterns designed according to the techniques described above are best realized by minimizing the relative gain and phase differences between inputs to the transform matrix. Gain and phase correction circuits 94 are used to correct errors which may be introduced by circuitry between combiners 48–54 to the input of transform matrix 96, which includes amplifiers 82–88 and the cabling up the antenna tower that connects amplifiers 82–88 to transform matrix 96.

Figure 4:
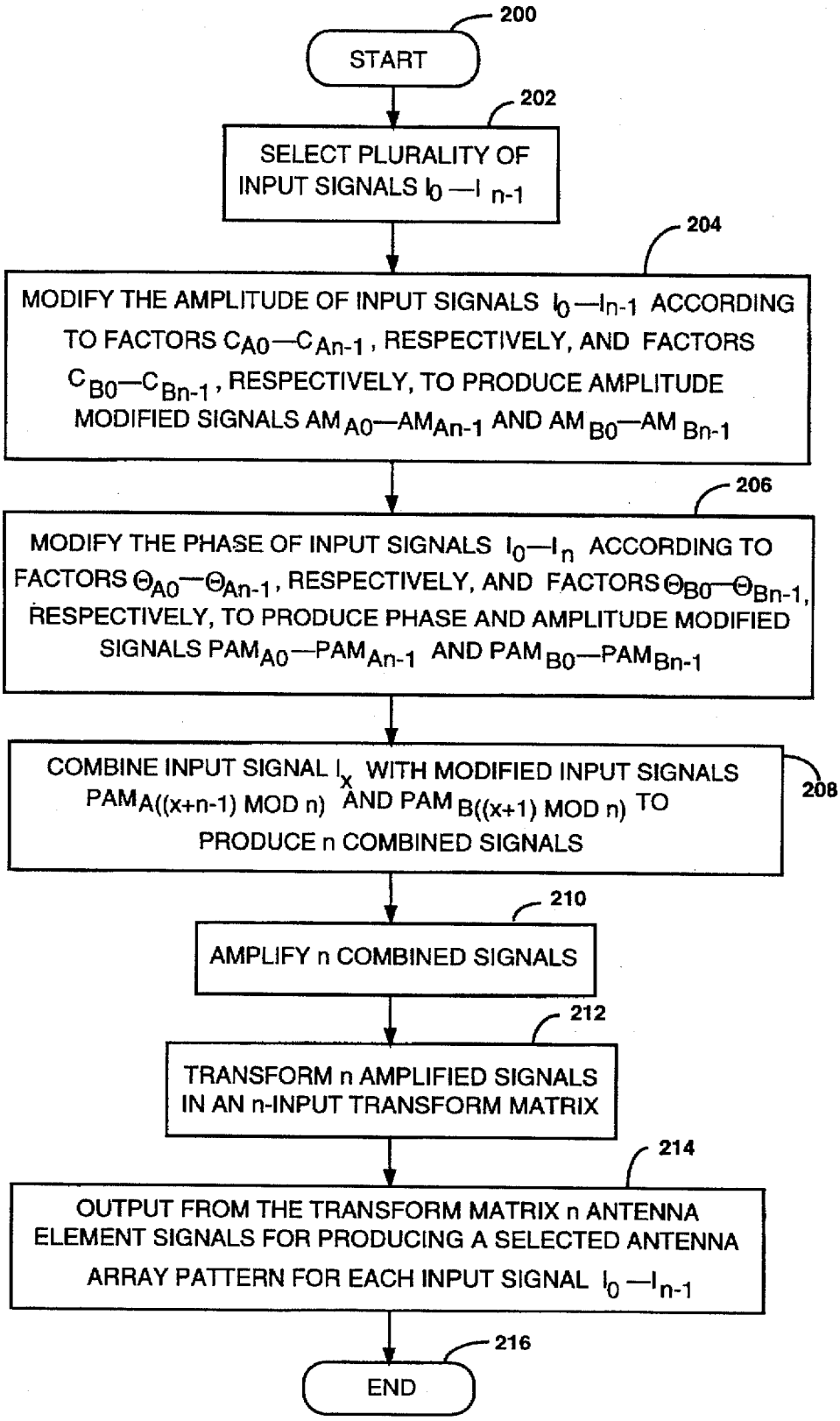
FIG. 4 is a high-level logic flow chart which illustrates the method for producing a plurality of antenna element signals in accordance with the present invention.

With reference to FIG. 4, there is depicted a logical flowchart of the process of producing a plurality of antenna element signals for producing a selected antenna array pattern according to the method and system of the present invention. As illustrated, the process begins at block 200, and thereafter passes to block 202 wherein a plurality of input signals, $I_0$–$I_{n-1}$, are selected. Each input to the system receives a signal that will be transmitted by the antenna array in a different direction. Thus, the input signal received by input 0 may be transmitted on one direction, while the signal received by input 1 is transmitted in another direction.

Next, the process modifies the amplitudes of input signals $I_0$–$I_{n-1}$ by factors $C_{A0}$–$C_{An-1}$ and $C_{B0}$–$C_{Bn-1}$, respectively, to produce 2n amplitude modified signals $AM_{A0}$–$AM_{An-1}$ and $AM_{B0}$–$AM_{Bn-1}$, as illustrated at block 204. This may be done with signal gain modifiers 64–78 in FIG. 3.

Thereafter, the process modifies the phase of input signals $I_0$–$I_{n-1}$ by factors $\theta_{A0}$–$\theta_{An-1}$ and $\theta_{B0}$–$\theta_{Bn-1}$, respectively, to produce 2n phase and amplitude modified signals $PAM_{A0}$–$PAM_{An-1}$ and $PAM_{B0}$–$PAM_{Bn-1}$, as depicted at block 206. In this figure, the steps of modifying the amplitude and phase of a signal are shown separately because modifying the phase as depicted in block 206 is an optional step. It should be recognized that if both the phase and amplitude of an input signal is modified, this modification may take place in substantially the same circuit at substantially the same time. Circuits that modify gain and or phase of a signal—such as signal gain modifiers 64–78—may be implemented with either analog or digital circuitry.

After modifying the phase and gain of input signals $I_0$–$I_{n-1}$, each input signal $I_x$ is combined with modified input signals $PAM_{A((x+n-1)\ mod\ n)}$ and $PAM_{B((x+1)mod\ n)}$ to produce n combined signals, as illustrated at block 208. This combining may be implemented with combiners 48–54 in FIG. 3.

Next, the n combined signals are amplified, as depicted in block 210. This amplifying step may be implemented with an amplifier array, such as amplifier array 80 illustrated in FIG. 3. As shown in FIG. 3, amplifier array 80 may include gain and phase correction circuits such as amplitude and phase sensors 90, gain and phase error measurement circuit 92, and gain and phase correction circuits 94. These circuits reduce gain and phase differences between the input and output of a single amplifier and the differences between the outputs of different amplifiers. These relative changes in either the gain or phase of an amplified signal may introduce unwanted changes in the pattern of the antenna array.

After the signals are amplified, the n amplified signals are transformed in an n-input transform matrix, as illustrated in block 212. Such a transform matrix may be implemented with a Butler transform matrix, as discussed above. The Butler transform matrix is constructed of ideally lossless passive components, and is therefore well suited to perform final modifications to high power signals before they are transmitted from the transform matrix outputs to the antenna array elements.

Finally, as depicted in block 214, high-power antenna element signals are output from the transform matrix, ready to drive antenna elements and form selected antenna patterns for each input signal $I_0$–$I_{n-1}$.

The foregoing description of a preferred embodiment of the invention has been presented for the purpose of illustration and description. It is not intended to be exhaustive or to limit the invention to the precise form disclosed. Modifications or variations are possible in light of the above teachings. The embodiment was chosen and described to provide the best illustration of the principles of the invention and its practical application, and to enable one of ordinary skill in the art to utilize the invention in various embodiments and with various modifications as are suited to the particular use contemplated. All such modifications and variations are within the scope of the invention as determined by the appended claims when interpreted in accordance with the breadth to which they are fairly, legally, and equitably entitled.

What is claimed is:

1. A method for producing a plurality of antenna element signals for producing a selected antenna array pattern, said method comprising the steps of:

modifying the amplitude of a first input signal according to a first factor to produce a first modified signal;

modifying the amplitude of a second input signal according to a second factor to produce a second modified signal;

combining said first input signal and said second modified signal to produce a first combined signal;

combining said second input signal and said first modified signal to produce a second combined signal;

measuring a gain and phase of a first and second amplifier;

modifying the gain and phase of at least one of said first and second combined signals in response to said measured gain and phase to produce first and second amplifier input signals;

amplifying said first and said second amplifier input signals to produce amplified signals;

coupling each of said amplified signals to an input of a transform matrix; and transforming said amplified signals using said transform matrix to produce said antenna element signals.

2. The method for producing a plurality of antenna element signals according to claim 1 wherein said step of modifying the amplitude of said first input signal according to a first factor further includes modifying the phase and amplitude of said first input signal according to a first complex factor to produce a first phase and amplitude modified signal, and wherein said step of modifying the amplitude of said second input signal according to a second factor further includes modifying the phase and amplitude of said second input signal according to a second complex factor to produce a second phase and amplitude modified signal, and wherein said step of combining said first input signal and said step of combining said second input signal includes, respectively, combining said first input signal and said second phase and amplitude modified signal to produce a first combined signal and combining said second input signal and said first phase and amplitude modified signal to produce a second combined signal.

3. The method for producing a plurality of antenna element signals according to claim 1 wherein said first and second input signals are digital code division multiple access modulated signals.

4. The method for producing a plurality of antenna element signals according to claim 1 wherein said steps of measuring a gain and phase and modifying the gain and phase further include the steps of:

measuring the difference in gain and phase between a first and second amplifier; and modifying the gain and phase of at least one of said first and second combined signals so as to minimize said measured difference in gain and phase to produce first and second amplifier input signals.

5. A system for producing a plurality of antenna element signals for producing a selected antenna array pattern, said system comprising:

a transform matrix having first and second inputs and first and second outputs, said first and second outputs providing said plurality of antenna element signals for producing a selected antenna array pattern;

first and second amplifiers having outputs coupled, respectively, to said first and second inputs of said transform matrix;

first and second amplitude and phase sensors coupled to said outputs of said first and second amplifiers;

a gain and phase error measurement circuit coupled to said first and second amplitude and phase sensors;

a gain and phase correction circuit, responsive to said gain and phase error measurement circuit, having an output coupled to an input of said first amplifier;

first and second signal combiners having at least a first and a second signal combiner input, and having outputs coupled, respectively, to an input of said gain and phase correction circuit and an input of said second amplifier;

first and second signal gain modifiers, said first signal gain modifier having an output coupled to said second signal combiner input of said first signal combiner, and said second signal gain modifier having an output coupled to said second signal combiner input of said second signal combiner; and first and second modulators, said first modulator having an output coupled to said first signal combiner input of said first signal combiner and to an input of said second signal gain modifier, said second modulator having an output coupled to said first signal combiner input of said second signal combiner and to an input of said first signal gain modifier.

6. The system for producing a plurality of antenna element signals according to claim 5 wherein said transform matrix comprises a Butler transform matrix.

7. The system for producing a plurality of antenna element signals according to claim 5 wherein said first and second signal combiners comprise first and second signal summers.

8. The system for producing a plurality of antenna element signals according to claim 5 wherein said first and second signal gain modifiers comprise first and second amplitude modifiers.

9. The system for producing a plurality of antenna element signals according to claim 5 wherein said first and second signal gain modifiers comprise first and second phase and amplitude modifiers.

10. The system for producing a plurality of antenna element signals according to claim 5 wherein said first and second signal modulators comprise first and second code division multiple access signal modulators.

11. The system for producing a plurality of antenna element signals according to claim 5 wherein said gain and phase error measurement circuit further includes a gain and phase difference measurement circuit.

12. A system for producing a plurality of antenna element signals for producing a selected antenna array pattern, said system comprising:

means for modifying the amplitude of a first input signal according to a first factor to produce a first modified signal;

means for modifying the amplitude of a second input signal according to a second factor to produce a second modified signal;

means for combining said first input signal and said second modified signal to produce a first combined signal;

means for combining said second input signal and said first modified signal to produce a second combined signal;

means for measuring a gain and phase of a first and second amplifier;

means for modifying the gain and phase of at least one of said first and second combined signals in response to said measured gain and phase to produce first and second amplifier input signals;

a first amplifier coupled to said first amplifier input signal to produce a first amplified signal;

a second amplifier coupled to said second amplifier input signal to produce a second amplified signal;

a transform matrix for transforming said amplified signals and producing said antenna element signals, said transform matrix having first and second inputs coupled to said first and second amplified signals, respectively.

13. The system for producing a plurality of antenna element signals according to claim 12 wherein said means for modifying the amplitude of said first input signal according to a first factor further includes means for modifying the phase and amplitude of said first input signal according to a first complex factor to produce a first phase and amplitude modified signal, and wherein said means for modifying the amplitude of said second input signal according to a second factor further includes means for modifying the phase and amplitude of said second input signal according to a second complex factor to produce a second phase and amplitude modified signal, and wherein said means for combining said first input signal and said means for combining said second input signal include, respectively, means for combining said first input signal and said second phase and amplitude modified signal to produce a first combined signal and means for combining said second input signal and said first phase and amplitude modified signal to produce a second combined signal.

14. The system for producing a plurality of antenna element signals according to claim 12 wherein said first and second input signals are digital code division multiple access modulated signals.

15. The system for producing a plurality of antenna element signals according to claim 12 wherein said means for measuring a gain and phase and means for modifying the gain and phase further include:

means for measuring the difference in gain and phase between a first and second amplifier; and means for modifying the gain and phase of at least one of said first and second combined signals so as to minimize said measured difference in gain and phase to produce first and second amplifier input signals.

* * * * *